US006131490A

United States Patent [19]

Lee

[11] Patent Number: 6,131,490

[45] Date of Patent: Oct. 17, 2000

[54] RATCHET WRENCH

[76] Inventor: Grace Lee, 58, Ma Yuan West St., Taichung, Taiwan

[21] Appl. No.: 09/267,203

[22] Filed: Mar. 12, 1999

[51] Int. Cl.[7] ..... B25B 13/46; B25G 1/04

[52] U.S. Cl. ..... 81/63.1; 81/177.9; 81/177.2

[58] Field of Search ..... 81/60–63.2, 177.7–177.9, 81/177.2

[56] References Cited

U.S. PATENT DOCUMENTS

| | | | |
|---|---|---|---|
| 4,463,632 | 8/1984 | Parke | 81/177.9 |
| 5,862,723 | 1/1999 | Rowlands | 81/177.9 |

FOREIGN PATENT DOCUMENTS

| | | | |
|---|---|---|---|
| 0027238 | 4/1981 | European Pat. Off. | 81/177.9 |

*Primary Examiner*—D. S. Meislin

[57] ABSTRACT

A ratchet wrench has a ratchet head, a handle having an end recess receiving the ratchet head, and a sleeve receiving the handle. A pivot pin fastens the ratchet head and the handle. A retainer ring which surrounds the sleeve has an eccentric hole. The handle has a first blind hole receiving a first spring and a first positioning ball, a second blind hole receiving a second spring and a first positioning pin, a recess hole receiving a second positioning ball, a first groove receiving a compression spring, a spherical ball, and a block, and a second groove receiving a shaft. The shaft has a positioning recess and a slant recess. The block has a bevel end and a recess aperture receiving a coiled spring and a steel ball. The sleeve has a slant groove, an oblong hole receiving a pressing pin, and a through aperture.

2 Claims, 10 Drawing Sheets

RATCHET WRENCH

BACKGROUND OF THE INVENTION

The present invention relates to a ratchet wrench. More particularly, the present invention relates to a ratchet wrench which can adjust angles and lengths.

A conventional ratchet wrench cannot adjust an angle of a ratchet head. Another conventional ratchet wrench can adjust an angle of a ratchet head. However, the ratchet head cannot be positioned stably after the angle of the ratchet head is adjusted.

SUMMARY OF THE INVENTION

An object of the present invention is to provide a ratchet wrench which can adjust an angle of a ratchet head. The ratchet head can be positioned stably after the angle of the ratchet head is adjusted.

Another object of the present invention is to provide a ratchet wrench which can adjust a length of the ratchet wrench.

Another object of the present invention is to provide a ratchet wrench which is easily disassembled.

Accordingly, a ratchet wrench comprises a ratchet head having a neck portion and a ratchet portion, a handle having an end recess receiving the neck portion, and a sleeve receiving a portion of the handle. A pivot pin fastens the ratchet head and the handle together. A retainer ring surrounds a first end of the sleeve. The retainer ring has an eccentric hole. The handle has a first blind hole receiving a first spring and a first positioning ball, a second blind hole receiving a second spring and a first positioning pin, a recess hole receiving a second positioning ball, a first groove receiving a compression spring, a spherical ball, and a block, and a second groove receiving a shaft. The shaft has a positioning recess and a slant recess. The block has a bevel end and a recess aperture receiving a coiled spring and a steel ball. The positioning recess receives the spherical ball. The slant recess receives the steel ball. The bevel end engages with the slant recess. The first groove is perpendicular to the second groove. The sleeve has a slant groove, an oblong hole receiving a pressing pin, and a through aperture. The ratchet portion engages with the block.

DETAILED DESCRIPTION OF THE INVENTION

Figure 1:
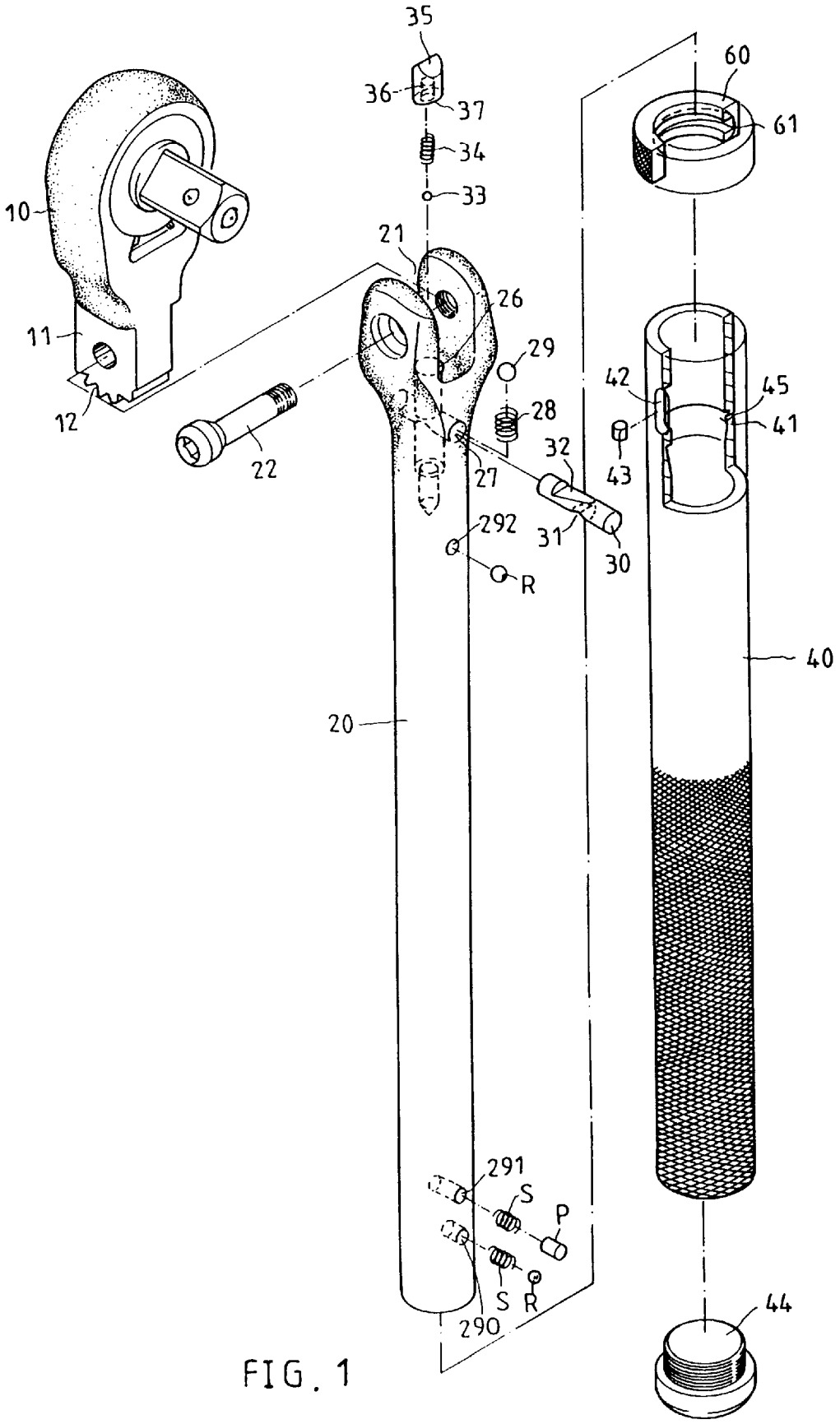
FIG. 1 is a perspective exploded view of a ratchet wrench of a preferred embodiment in accordance with the present invention.
Figure 2:
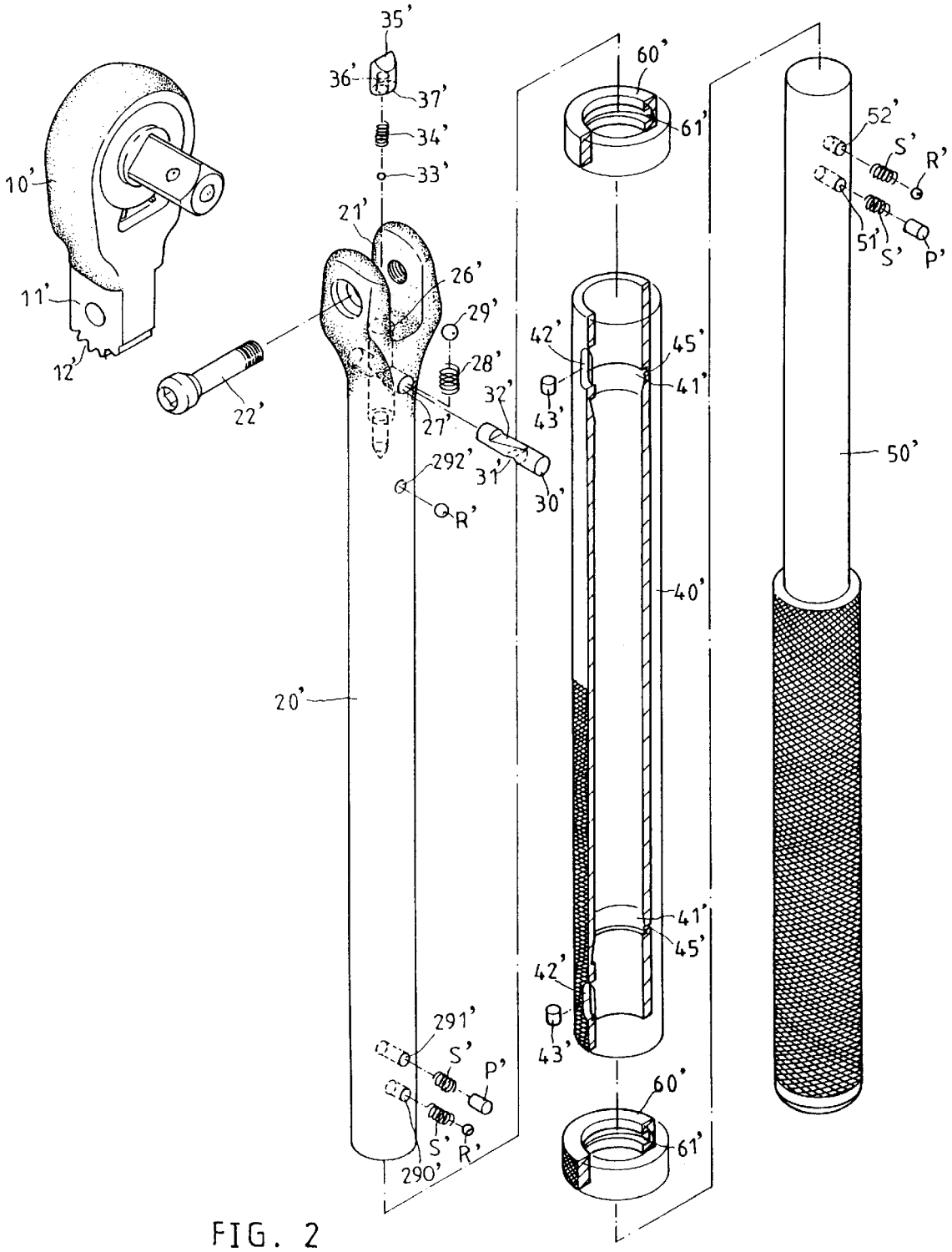
FIG. 2 is a perspective exploded view of a ratchet wrench of another preferred embodiment in accordance with the present invention.
Figure 4:
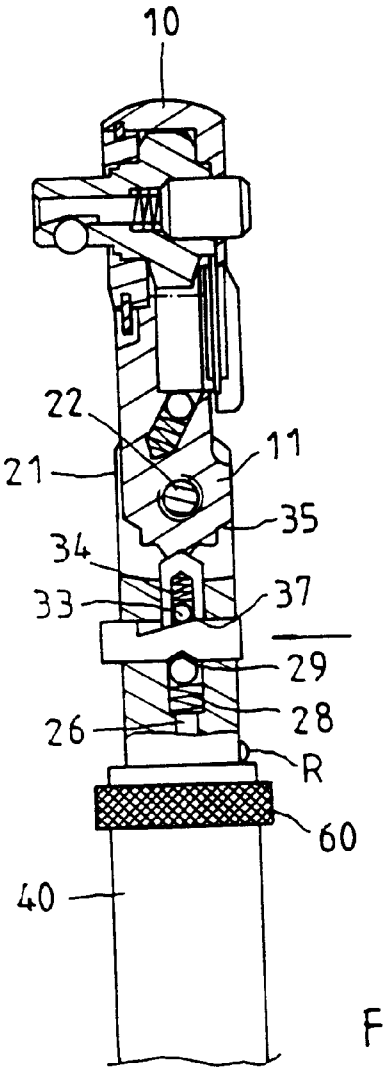
FIG. 4 is a schematic view illustrating an angle between a handle and a ratchet head is one hundred and eighty degrees.
Figure 3:
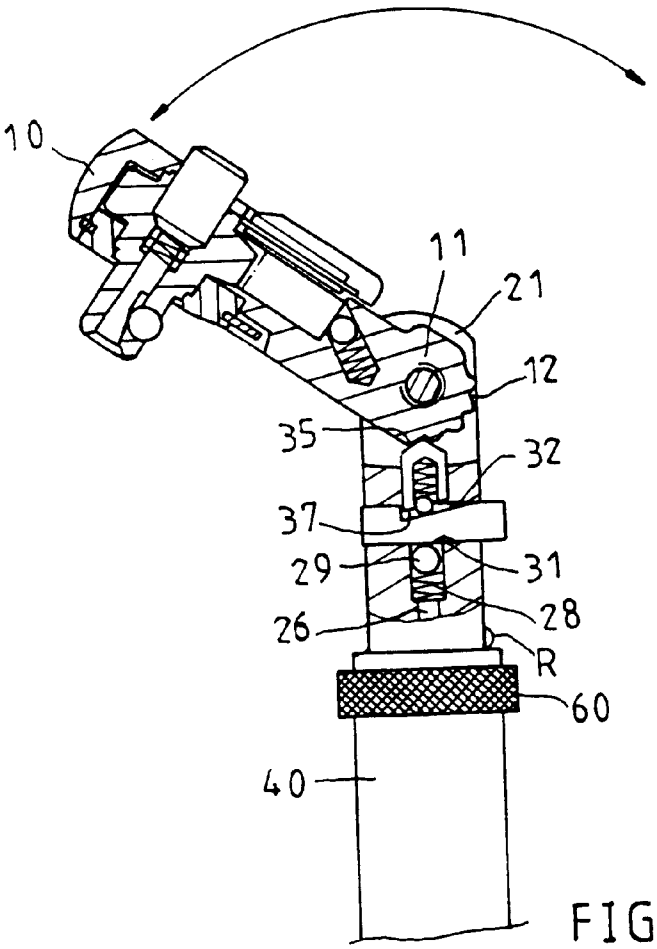
FIG. 3 is a schematic view illustrating an adjustment of an angle of a ratchet head of a preferred embodiment in accordance with the present invention.
Figure 5:
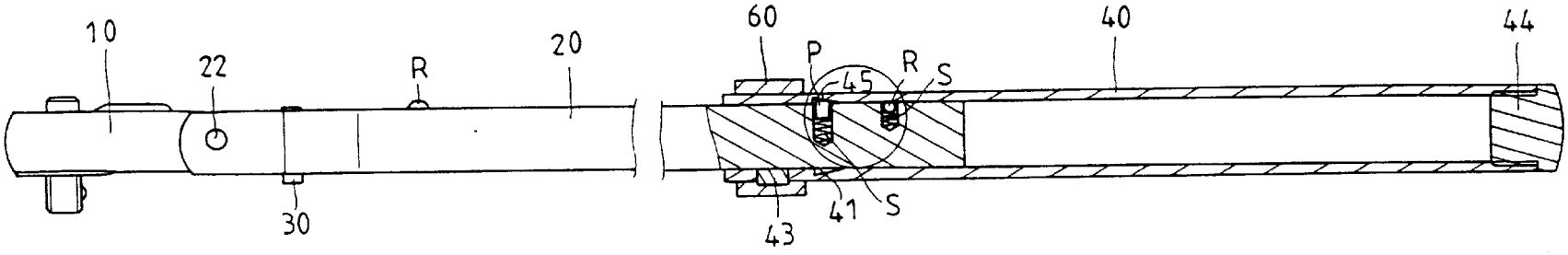
FIG. 5 is a sectional schematic view illustrating a ratchet wrench of a preferred embodiment is extended.
Figure 5A:
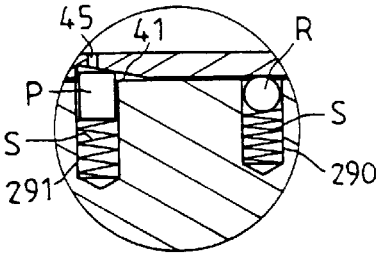
FIG. 5A is a partially sectional schematic view illustrating a positioning ball and a positioning pin retaining a handle in a sleeve of a preferred embodiment.
Figure 6:
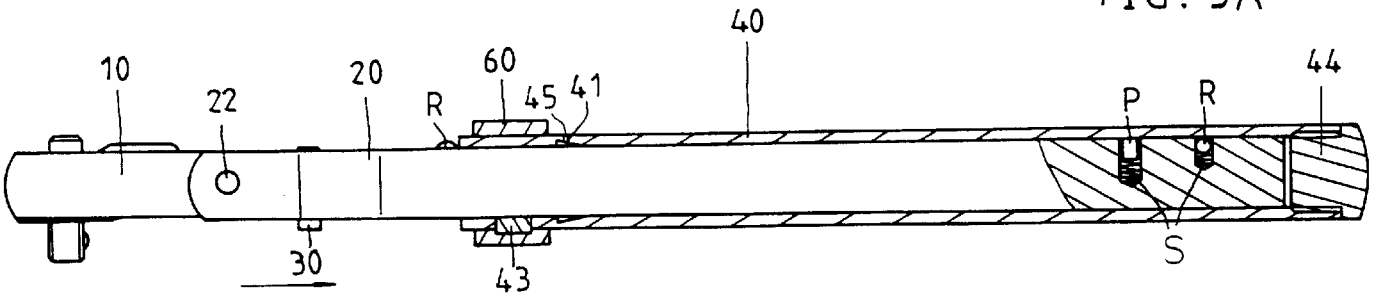
FIG. 6 is a sectional schematic view illustrating a ratchet wrench of a preferred embodiment is shortened.
Figure 7:
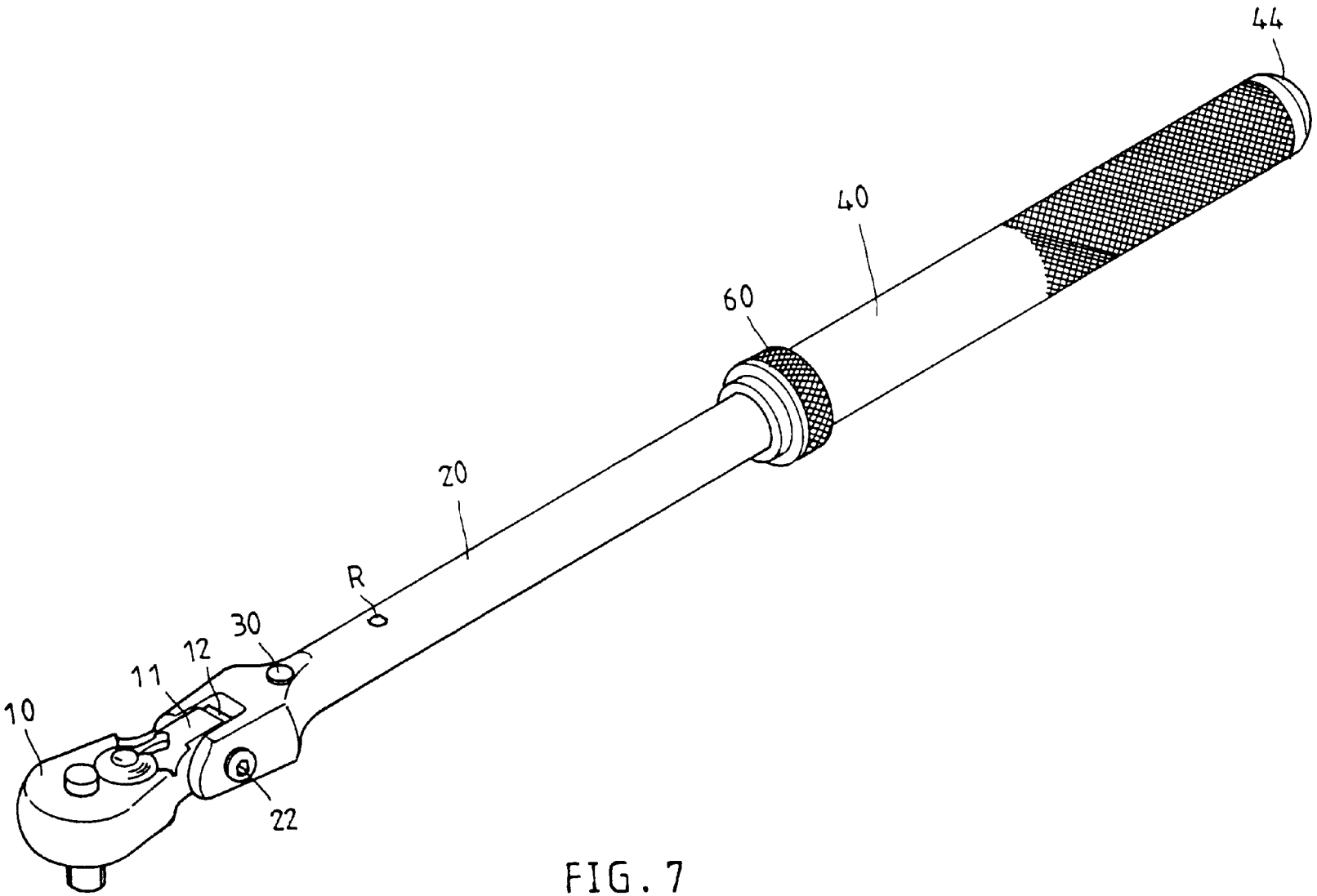
FIG. 7 is a perspective schematic view illustrating a ratchet wrench of a preferred embodiment is extended.
Figure 8:
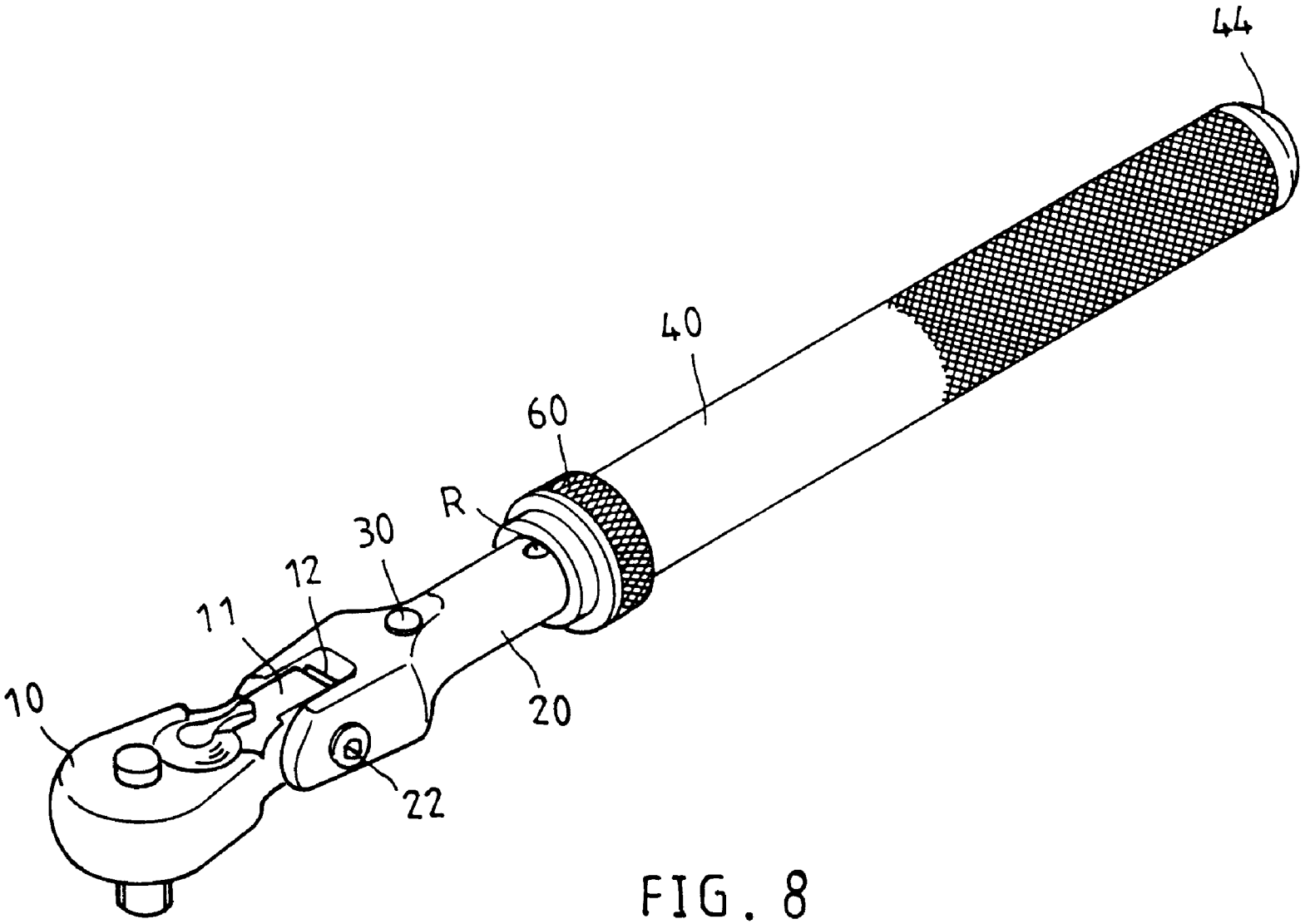
FIG. 8 is a perspective schematic view illustrating a ratchet wrench of a preferred embodiment is shortened.
Figure 9:
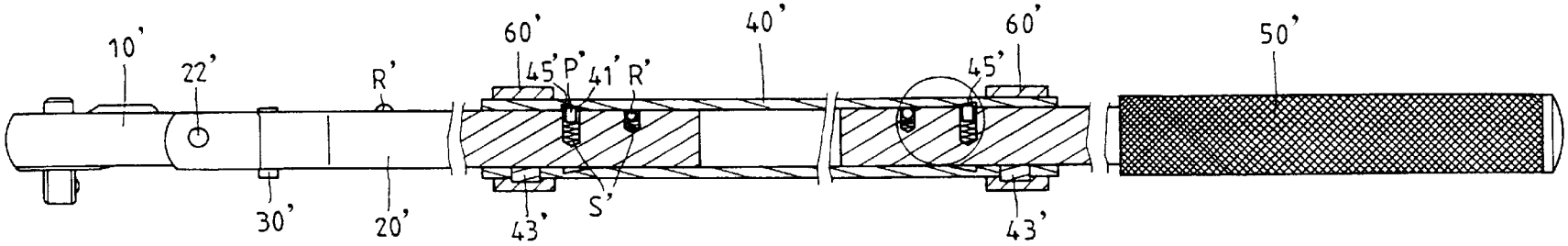
FIG. 9 is a sectional schematic view illustrating a ratchet wrench of another preferred embodiment is extended.
Figure 9A:
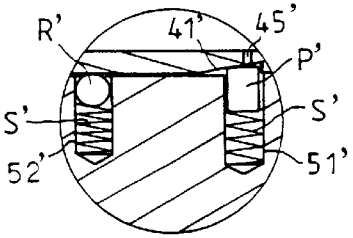
FIG. 9A is a partially sectional schematic view illustrating a positioning ball and a positioning pin retaining a handle in a sleeve of another preferred embodiment.
Figure 10:
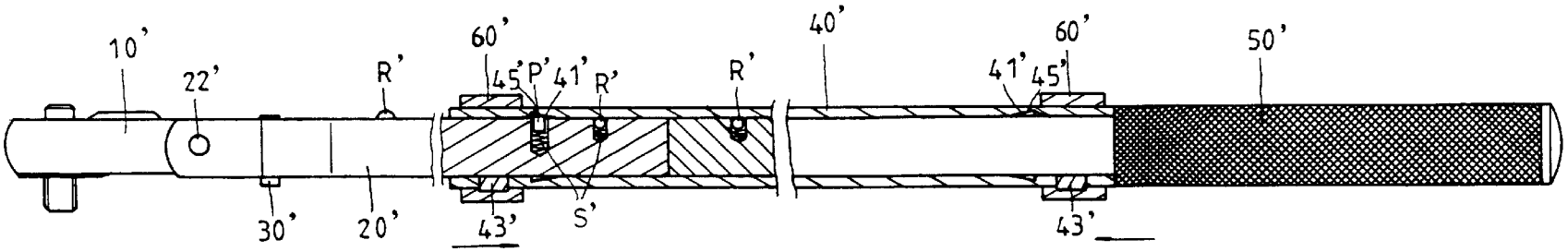
FIG. 10 is a sectional schematic view illustrating a ratchet wrench of another preferred embodiment is shortened.
Figure 11:
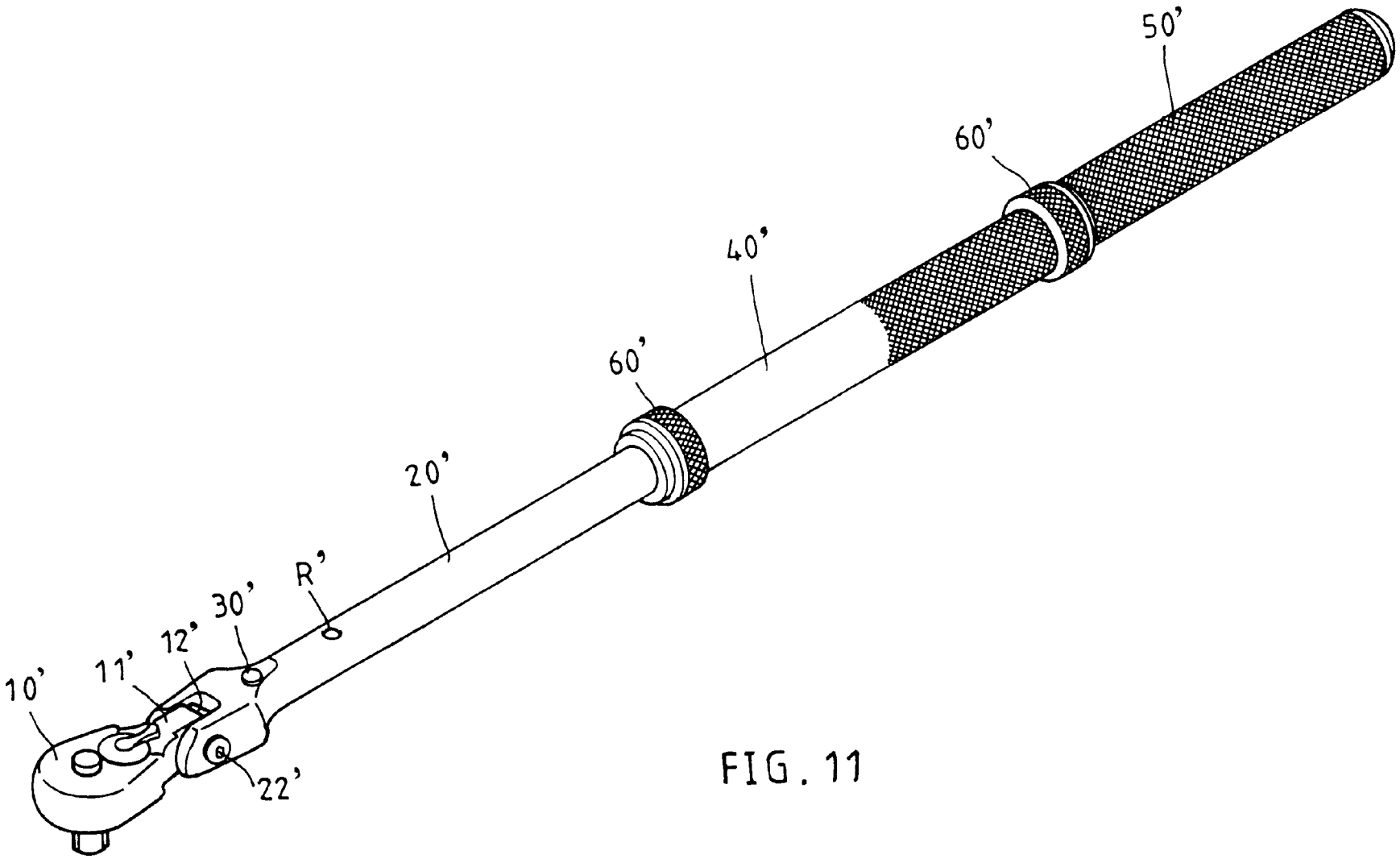
FIG. 11 is a perspective schematic view illustrating a ratchet wrench of another preferred embodiment is shortened.
Figure 12:
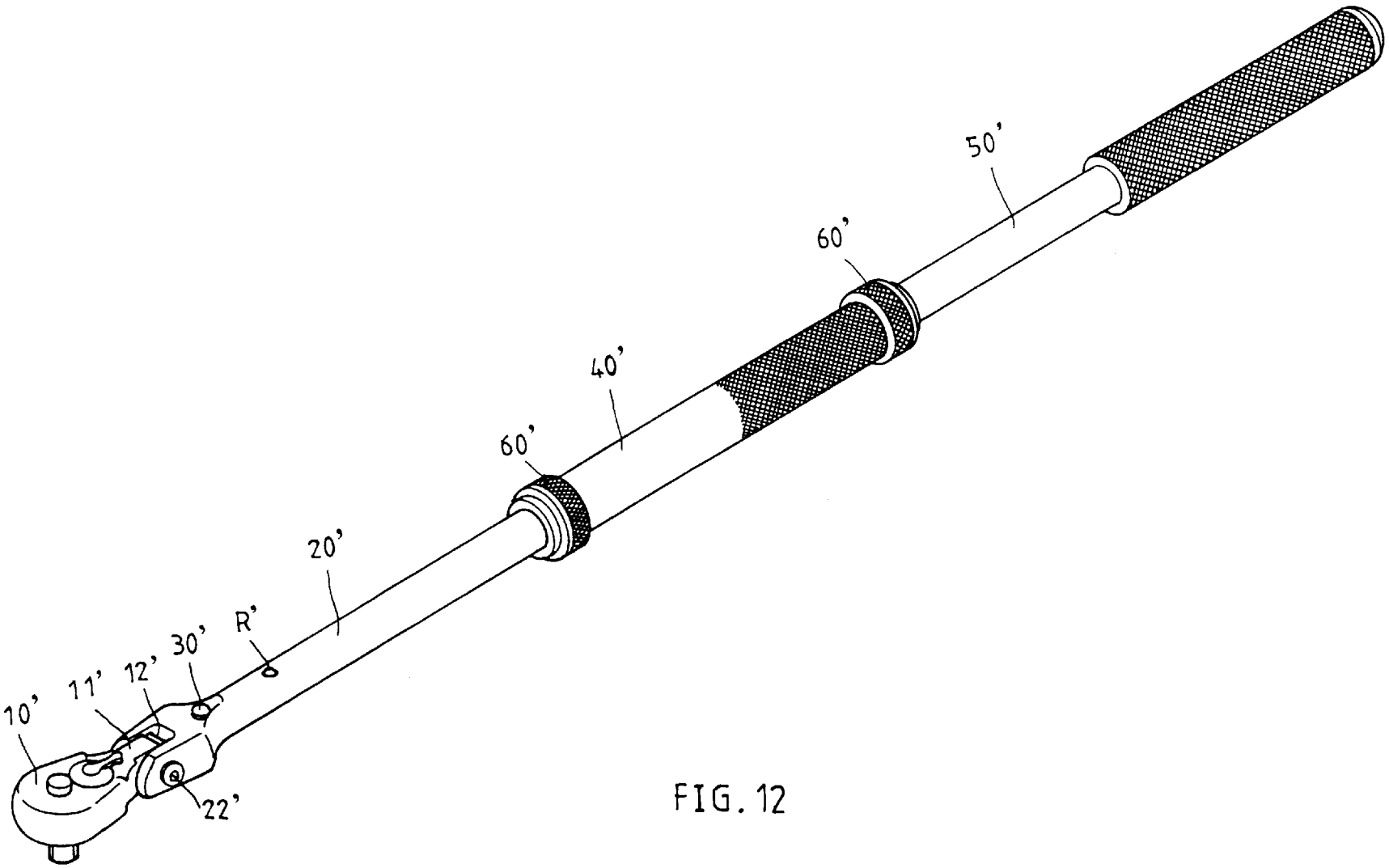
FIG. 12 is a perspective schematic view illustrating a ratchet wrench of another preferred embodiment is extended.

Referring to FIGS. 1, 3 to 8, 13 and 14, a ratchet wrench comprises a ratchet head 10 having a neck portion 11 and a ratchet portion 12, a handle 20 having an end recess 21 receiving the neck portion 11, and a sleeve 40 receiving a portion of the handle 20. A pivot pin 22 fastens the ratchet head 10 and the handle 20 together.

A first retainer ring 60 surrounds a first end of the sleeve 40. The first retainer ring 60 has an eccentric hole 61.

An end plug 44 plugs a second end of the sleeve 40.

The handle 20 has a first blind hole 290 receiving a first spring S and a first positioning ball R, a second blind hole 291 receiving a second spring S and a first positioning pin P, a recess hole 292 receiving a second positioning ball R, a first groove 26 receiving a compression spring 28, a spherical ball 29, and a block 35, and a second groove 27 receiving a shaft 30. The shaft 30 has a positioning recess 31 and a slant recess 32. The block 35 has a bevel end 37 and a recess aperture 36 receiving a coiled spring 34 and a steel ball 33. The positioning recess 31 receives the spherical ball 29. The slant recess 32 receives the steel ball 33. The bevel end 37 engages with the slant recess 32.

The first groove 26 is perpendicular to the second groove 27.

The sleeve 40 has a slant groove 41, an oblong hole 42 receiving a pressing pin 43, and a through aperture 45.

The ratchet portion 12 engages with the block 35.

Referring to FIGS. 5 and 6 again, the angle of the ratchet head 10 is adjusted. The shaft 30 is removed. The user rotates the ratchet head 10 until the ratchet portion 12 engaging with the block 35 again. Then the shaft 30 is inserted in the second groove 27.

Figure 13:
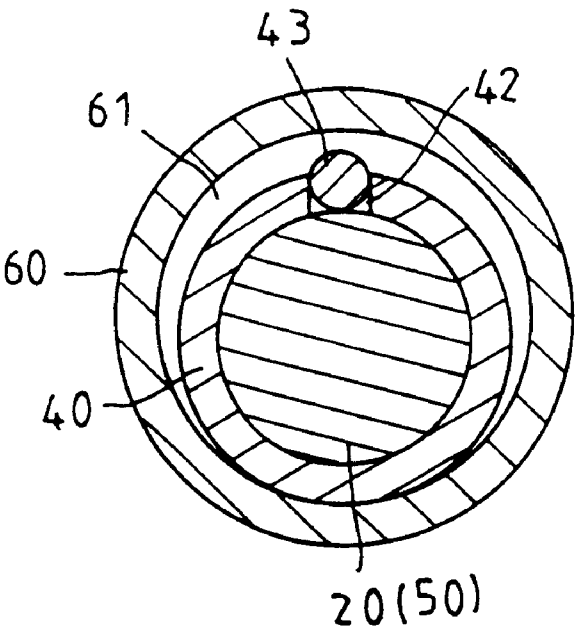
FIG. 13 is a sectional schematic view illustrating a retainer ring is in a loosening state.

Referring to FIG. 13, the first retainer ring 60 is rotated until reaching a loosening state. The sleeve 40 can be moved along the handle 20.

Figure 14:
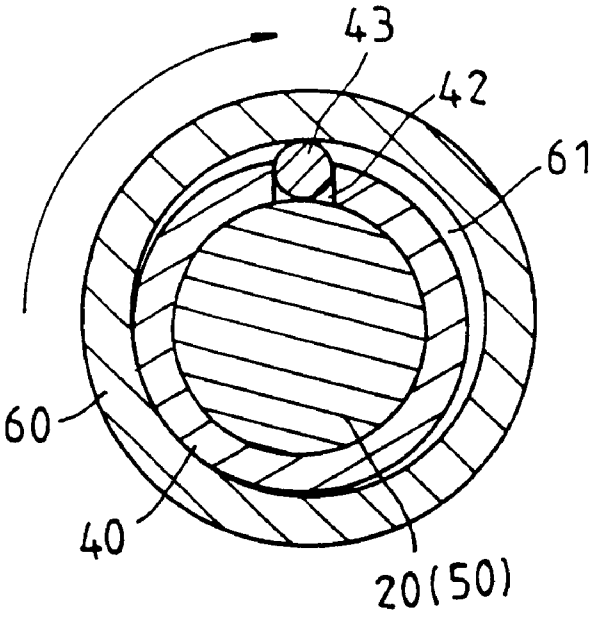
FIG. 14 is a sectional schematic view illustrating a retainer ring is in a tightening state.

Referring to FIG. 14, the first retainer ring 60 is rotated until reaching a tightening state. The sleeve 40 cannot be moved along the handle 20.

Referring to FIGS. 2, and 9 to 12, another ratchet wrench comprises a ratchet head 10' having a neck portion 11' and a ratchet portion 12', a handle 20' having an end recess 21' receiving the neck portion 11', and a sleeve 40' receiving a portion of the handle 20'. A pivot pin 22' fastens the ratchet head 10' and the handle 20' together.

A first retainer ring 60' surrounds a first end of the sleeve 40'. The first retainer ring 60' has a first eccentric hole 61'. A second retainer ring 60' surrounds a second end of the sleeve 40'. The second retainer ring 60' has a second eccentric hole 61'.

The handle 20' has a first blind hole 290' receiving a first spring S' and a first positioning ball R', a second blind hole 291' receiving a second spring S' and a first positioning pin P', a recess hole 292' receiving a second positioning ball R', a first groove 26' receiving a compression spring 28', a spherical ball 29', and a block 35', and a second groove 27' receiving a shaft 30'. The shaft 30' has a positioning recess 31' and a slant recess 32'. The block 35' has a bevel end 37' and a recess aperture 36' receiving a coiled spring 34' and a steel ball 33'. The positioning recess 31' receives the spherical ball 29'. The slant recess 32' receives the steel ball 33'. The bevel end 37' engages with the slant recess 32'. The first groove 26' is perpendicular to the second groove 27'.

The sleeve 40' has a pair of slant grooves 41', a pair of oblong holes 42', and a pair of through apertures 45'. Each of the oblong holes 42' receives a pressing pin 43'.

The ratchet head 12' engages with the block 35'.

An extension rod 50' has a first blind aperture 51' receiving a third spring S' and a second positioning pin P', and a second blind aperture 52' receiving a fourth spring S' and a third positioning ball R'.

A portion of the extension rod 50' is inserted in the sleeve 40'.

The invention is not limited to the above embodiment but various modification thereof may be made. Further, various changes in form and detail may be made without departing from the scope of the invention.

I claim:

1. A ratchet wrench comprises:

a ratchet head having a neck portion and a ratchet portion, a handle having an end recess receiving the neck portion, and a sleeve receiving a portion of the handle, a pivot pin fastening the ratchet head and the handle together, a retainer ring surrounding a first end of the sleeve, the retainer ring having an eccentric hole, the handle having a first blind hole receiving a first spring and a first positioning ball, a second blind hole receiving a second spring and a first positioning pin, a recess hole receiving a second positioning ball, a first groove receiving a compression spring, a spherical ball, and a block, and a second groove receiving a shaft, the shaft having a positioning recess and a slant recess, the block having a bevel end and a recess aperture receiving a coiled spring and a steel ball, the positioning recess receiving the spherical ball, the slant recess receiving the steel ball, the bevel end engaging with the slant recess, the first groove perpendicular to the second groove, the sleeve having a slant groove, an oblong hole receiving a pressing pin, and a through aperture, and the ratchet portion engaging with the block.

2. A ratchet wrench as claimed in claim 1, wherein an extension rod has a first blind aperture receiving a third spring and a second positioning pin, and a second blind aperture receiving a fourth spring and a third positioning ball, and a portion of the extension rod is inserted in the sleeve.

* * * * *